US009752583B2

(12) United States Patent
Xu

(10) Patent No.: US 9,752,583 B2
(45) Date of Patent: Sep. 5, 2017

(54) PUMP ASSEMBLY FOR APPLIANCE

(71) Applicant: General Electric Company, Schenectady, NY (US)

(72) Inventor: Hanping Xu, Louisville, KY (US)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 445 days.

(21) Appl. No.: 14/507,887

(22) Filed: Oct. 7, 2014

(65) Prior Publication Data

US 2016/0097392 A1 Apr. 7, 2016

(51) Int. Cl.

| | |
|---|---|
| ***F04D 13/06*** | (2006.01) |
| ***F04D 29/42*** | (2006.01) |
| ***F04D 29/22*** | (2006.01) |
| ***F04D 29/10*** | (2006.01) |
| ***A47L 15/42*** | (2006.01) |
| ***F04D 1/00*** | (2006.01) |
| ***F04D 13/08*** | (2006.01) |
| ***F04D 29/08*** | (2006.01) |

(52) U.S. Cl.

CPC ..... *F04D 13/0693* (2013.01); *A47L 15/4225* (2013.01); *F04D 13/086* (2013.01); *F04D 29/086* (2013.01); *F04D 1/00* (2013.01)

(58) Field of Classification Search

CPC .. F04D 13/0693; F04D 29/086; F04D 13/086; F04D 1/00; A47L 15/4225

See application file for complete search history.

(56) References Cited

U.S. PATENT DOCUMENTS

| | | | | |
|---|---|---|---|---|
| 2,556,435 | A * | 6/1951 | Moehrl | F04D 29/061 310/157 |
| 3,560,823 | A * | 2/1971 | Nystuen | H02K 17/04 310/267 |
| 3,587,939 | A * | 6/1971 | Neumann | A47L 15/4225 137/565.37 |
| 4,861,240 | A * | 8/1989 | Marioni | A47L 15/4225 416/244 R |
| 6,296,459 | B1 * | 10/2001 | Saputo | F04D 17/164 415/208.2 |
| 6,379,127 | B1 * | 4/2002 | Andrews | F04D 13/083 277/387 |
| 7,409,962 | B2 | 8/2008 | Welch | |

(Continued)

FOREIGN PATENT DOCUMENTS

JP 2005146970 A 6/2005

OTHER PUBLICATIONS

IP Rating Chart, www.dsmt.com/resources/ip-rating-chart/, Feb. 2017.*

*Primary Examiner* — Michael Barr
*Assistant Examiner* — Benjamin L Osterhout
(74) *Attorney, Agent, or Firm* — Dority & Manning, P.A.

(57) ABSTRACT

Appliances, such as dishwasher appliances, and pump assemblies for appliances are provided. A pump assembly includes a conduit, the conduit including a casing extending between an inlet and an outlet and defining an inner passage between the inlet and the outlet. The pump assembly further includes an impeller disposed within the inner passage, and a motor connected to the impeller and operable to rotate the impeller, the motor disposed within the inner passage. Fluid flowing within the inner passage is flowable past the motor.

17 Claims, 3 Drawing Sheets

(56) References Cited

U.S. PATENT DOCUMENTS

| | | | | |
|---|---|---|---|---|
| 2011/0186095 | A1* | 8/2011 | Kim | A47L 15/4204<br>134/184 |
| 2012/0138106 | A1* | 6/2012 | Fountain | A47L 15/0084<br>134/111 |
| 2012/0138107 | A1* | 6/2012 | Fountain | A47L 15/0084<br>134/111 |
| 2013/0294928 | A1* | 11/2013 | Rosinski | F04D 13/06<br>417/5 |
| 2014/0112808 | A1 | 4/2014 | Moore et al. | |

* cited by examiner

PUMP ASSEMBLY FOR APPLIANCE

FIELD OF THE INVENTION

The subject matter of the present disclosure relates generally to appliances, such as dishwasher appliances, and more particularly to pump assemblies for use in such appliances.

BACKGROUND OF THE INVENTION

Many appliances utilize fluids for various purposes, such as cleaning purposes, fluid supply purposes, etc. Dishwashers, washing machines, and refrigerators are examples of such appliances. Such appliances typically include conduits for flowing fluids therethrough, both for use in the appliance and for drainage from the appliance. Additionally, pumps may be utilized to encourage fluid flow through such conduits.

A dishwasher appliance, for example, typically includes a pump for flowing fluid through a circulation pipe and a pump for flowing fluid through a drain pipe. The circulation pipe circulates fluid from a sump of the dishwasher appliance to spray assemblies which direct the fluid towards articles within the dishwasher appliance to clean such articles. The drain pipe drains fluid from the dishwasher appliance.

Known pumps utilized with appliances to encourage fluid flow through appliance conduits typically include an impeller positioned within a housing through which the fluid is flowed and a motor positioned outside of the housing. The conduit is in fluid communication with the housing, such that the fluid is encouraged through the conduit by the impeller. In many cases, the outlet is generally perpendicular to the inlet, such that fluid flowing past the impeller must make a radial turn to exit the housing into the conduit. The motor, which is typically a synchronous or three-phase motor, is partitioned from the housing and conduit such that fluid generally does not contact the motor.

Recent rules and regulations have made the use of such pump arrangements relatively burdensome. For example, various requirements with respect to power and vibration have caused increases in pump costs and decreases in efficiency when pumps are designed to meet such requirements.

Accordingly, improved pump assemblies for appliances are desired in the art. In particular, efficient and inexpensive pump assemblies which satisfy energy requirements would be advantageous.

BRIEF DESCRIPTION OF THE INVENTION

In accordance with one embodiment, a pump assembly for an appliance is provided. The pump assembly includes a conduit, the conduit including a casing extending between an inlet and an outlet and defining an inner passage between the inlet and the outlet. The pump assembly further includes an impeller disposed within the inner passage, and a motor connected to the impeller and operable to rotate the impeller, the motor disposed within the inner passage. Fluid flowing within the inner passage is flowable past the motor.

In accordance with another embodiment, an appliance is provided. The appliance includes a fluid source, and a pump assembly in fluid communication with the fluid source for flowing fluid from the fluid source. The pump assembly includes a conduit, the conduit including a casing extending between an inlet and an outlet and defining an inner passage between the inlet and the outlet. The pump assembly further includes an impeller disposed within the inner passage, and a motor connected to the impeller and operable to rotate the impeller, the motor disposed within the inner passage. Fluid flowing within the inner passage is flowable past the motor.

In accordance with another embodiment, a dishwasher appliance is provided. The dishwasher appliance includes a tub that defines a wash chamber for receipt of articles for washing, and a sump for collecting fluid from the wash chamber. The dishwasher appliance further includes a pump assembly in fluid communication with the sump for flowing fluid from the sump. The pump assembly includes a conduit, the conduit including a casing extending between an inlet and an outlet and defining an inner passage between the inlet and the outlet. The pump assembly further includes an impeller disposed within the inner passage, and a motor connected to the impeller and operable to rotate the impeller, the motor disposed within the inner passage. Fluid flowing within the inner passage is flowable past the motor.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention including the best mode thereof, directed to one of ordinary skill in the art, is set forth in the specification, which makes reference to the appended figures, in which.

DETAILED DESCRIPTION OF THE INVENTION

Figure 1:
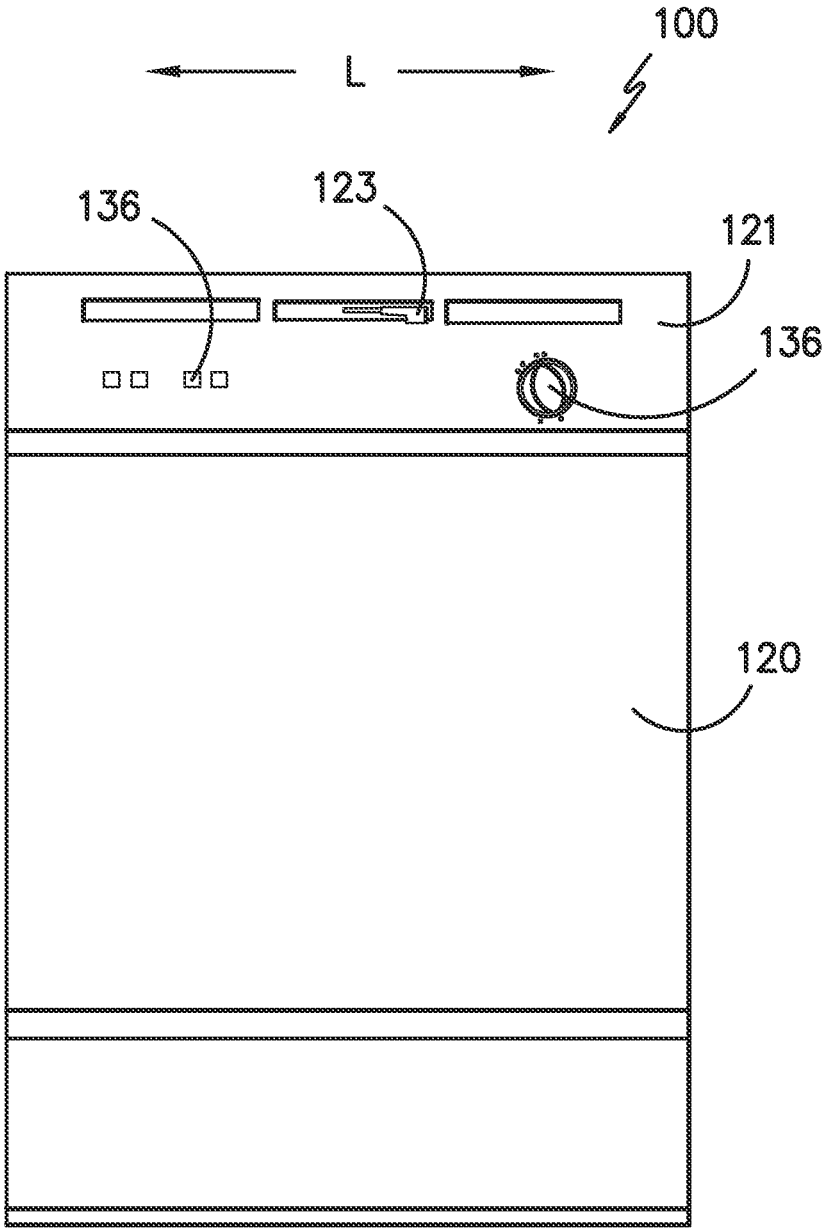
FIG. 1 provides a front view of a dishwasher appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments.

Figure 2:
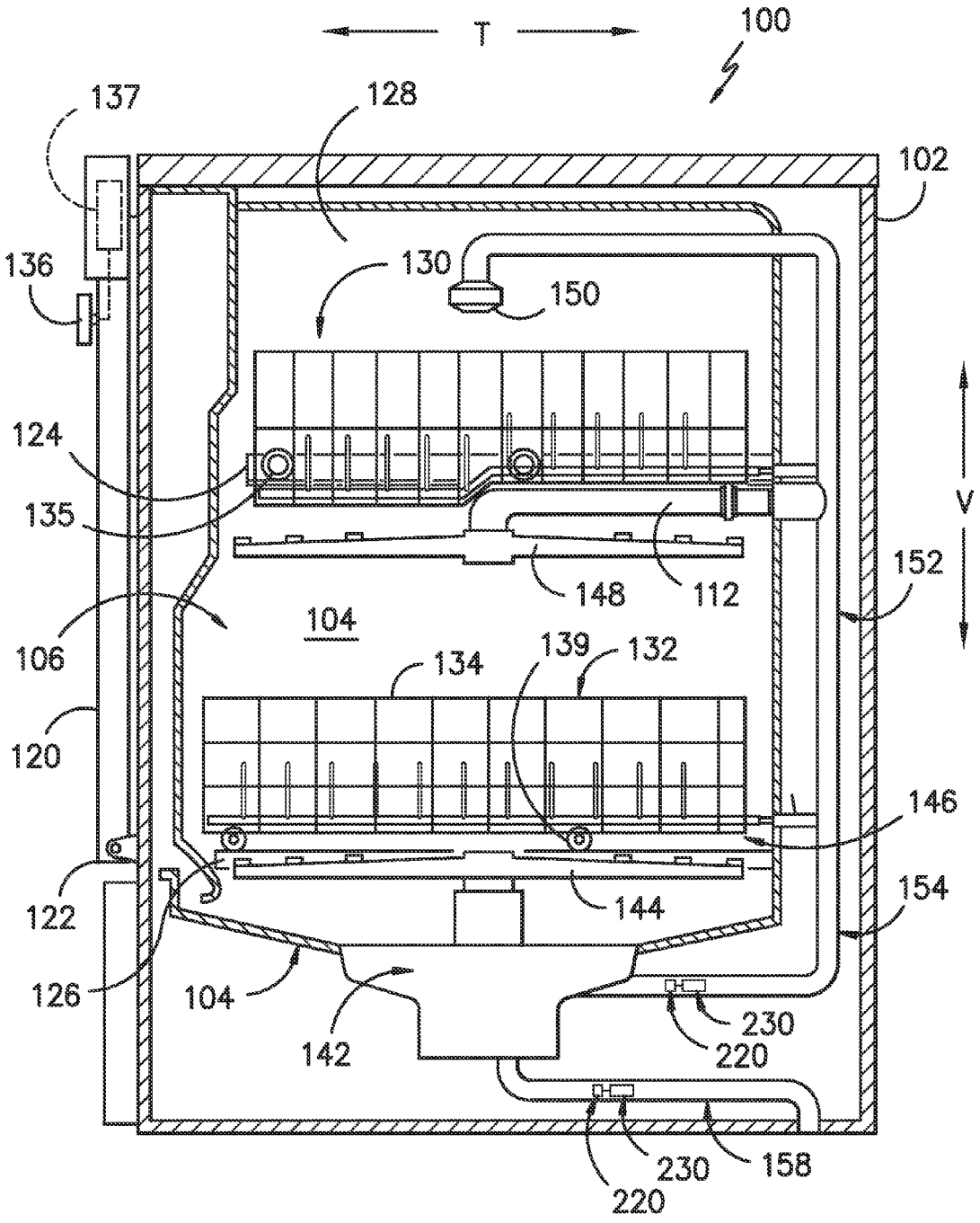
FIG. 2 provides a side, cross-sectional view of a dishwasher appliance in accordance with one embodiment of the present disclosure.

FIGS. 1 and 2 depict an exemplary domestic dishwasher 100 that may be configured in accordance with aspects of the present disclosure. For the particular embodiment of FIGS. 1 and 2, the dishwasher 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 123 is used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144 that is rotatably mounted within a lower region 146 of the wash chamber 106 and above a sump 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

Each spray-arm assembly 144, 148 includes an arrangement of discharge ports or orifices for directing fluid onto dishes or other articles located in rack assemblies 130 and 132. The arrangement of the discharge ports in spray-arm assemblies 144, 148 provides a rotational force by virtue of washing fluid flowing through the discharge ports. The resultant rotation of the spray-arm assemblies 144, 148 and the operation of spray assembly 150 provides coverage of dishes and other dishwasher contents with a washing spray. Other configurations of spray assemblies may be used as well.

The lower and mid-level spray-arm assemblies 144, 148 and the upper spray assembly 150 are part of a fluid circulation assembly 152 for circulating water and dishwasher fluid in the tub 104. Fluid circulation assembly 152 may further include a circulation conduit 154 which supplies the fluid to the lower and mid-level spray-arm assemblies 144, 148 and the upper spray assembly 150. The conduit 154 may, for example, be in fluid communication with the sump 142 such that fluid can flow from the sump 142 into the conduit 154 as required.

As mentioned, dishwasher assembly 100 further includes sump 142, which may be provided in lower region 146 below, for example, lower spray-arm assembly 144. Sump 142 generally collects fluid from the wash chamber 106 for circulation within the tub 104, such as back into the wash chamber 106 through fluid circulation assembly 152, as well as drainage from the tub 104 and dishwasher appliance 100 in general. Drainage may occur, for example, through a drain conduit 158 which is provided for draining fluid from the sump 142. The conduit 158 may, for example, be in fluid communication with the sump 142 such that fluid can flow from the sump 142 into the conduit 158 as required. Drain conduit 158 may flow the fluid from the sump 142 to, for example, external plumbing or another suitable drainage location.

The dishwasher 100 is further equipped with a controller 137 to regulate operation of the dishwasher 100. The controller may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, and other differences may be applied as well.

Figure 3:
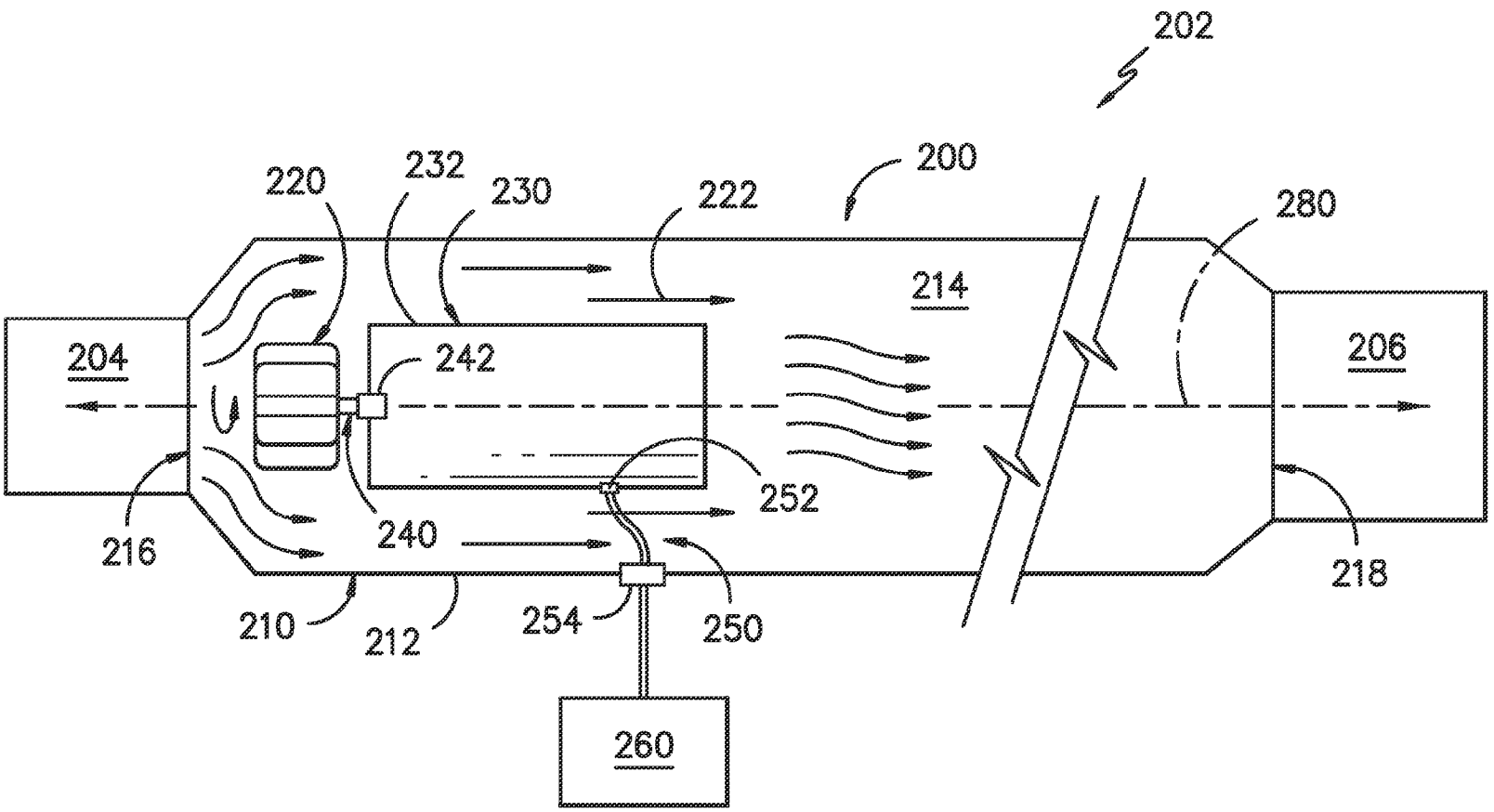
FIG. 3 provides a schematic view of a pump assembly in an appliance in accordance with one embodiment of the present disclosure.

Referring now to FIG. 3, a pump assembly 200 is provided for use in an appliance 202. In exemplary embodiments, the appliance 202 is a dishwasher appliance, such as dishwasher appliance 100. Alternatively, however, any suitable appliance which requires use of a pump to encourage fluid flow therethrough is within the scope and spirit of the present disclosure. For example, washing machines and refrigerators, as well as other suitable appliances, are contemplated.

The appliance 202 may include a fluid source 204. In embodiments wherein the appliance 202 is dishwasher appliance 100, for example, the fluid source 204 may be sump 142. Fluid source 204 may provide fluid which may be flowed past components of the pump assembly 200, as discussed herein. Appliance 202 may additionally include a fluid destination 206. In embodiments wherein the appliance 202 is dishwasher appliance 100, for example, the fluid destination 206 may include one or more spray assemblies, such as lower and mid-level spray-arm assemblies 144, 148 and the upper spray assembly 150, or may include external plumbing or another suitable drainage location. Fluid destination may be a location to which fluid may flow from fluid source 204 through pump assembly 200. Pump assembly 200 may thus be in fluid communication with the fluid source 204 and fluid destination 206.

Pump assembly 200 may include a conduit 210 through which fluid may flow. Conduit 210 may be any suitable pipe, hose, etc. in appliance 202. In some exemplary embodiments, for example, conduit 210 may be a circulation conduit, such as circulation conduit 154. In other embodiments, conduit 210 may be a drain conduit, such as drain conduit 158. Further, any suitable conduit through which fluid flows within an appliance is within the scope and spirit of the present disclosure.

Conduit 210 may include a casing 212 which defines an inner passage 214. The casing 212 may be formed from any suitable material and have any suitable shape and size. For example, casing 212 may be formed from a rigid or flexible plastic. In some embodiments, casing 212 or a portion thereof may be corrugated. Additionally or alternatively, casing 212 or a portion thereof may have a generally smooth inner and/or outer surface. Casing 212 may extend between an inlet 216 and an outlet 218. The inlet 216 may be in fluid communication with the fluid source 204, and the outlet 218 may be in fluid communication with the fluid destination 206. Accordingly, fluid may exit the fluid source 204 into the inner passage 214 through the inlet 216, and may exit the inner passage 214 through the outlet 218 into the fluid destination 206.

Pump assembly 200 further includes an impeller 220, which may be disposed within the inner passage 214. Rotation of the impeller 220 may generally encourage fluid flow through the conduit 210, such as through the inner passage 214 thereof. Fluid flow direction arrows 220 indicate the generally direction of flow of fluid past the impeller 220.

Pump assembly 200 further includes a motor 230. The motor 230 is connected to the impeller 220 and operable to rotate the impeller 220. Further, the motor 230 is disposed within the inner passage 214, such that fluid flowing within the inner passage 214 is flowable around and past the motor 230. In exemplary embodiments, the motor 230 is a low voltage direct current ("DC") motor. Alternatively, however, other suitable motors, such as high voltage and/or alternating current ("AC") motors, may be utilized.

In exemplary embodiments, the motor 230 is hermetically sealed or otherwise sealed such that fluid generally cannot enter the interior of the motor 230. An outer casing 232 of the motor 230 may, for example, provide such seal.

A shaft 240 may extend between the motor 230 and the impeller 220 to connect the motor 230 and impeller 220. The shaft 240 may extend through the outer casing 232, so a shaft seal 242 may be disposed between the shaft 240 and outer casing 232 to prevent fluid from flowing between the outer casing 232 and shaft 240 into the interior of the motor 230. The shaft seal 242 may thus maintain the hermetic or other seal of the motor 230 in general. Suitable types of shaft seals 242 include, for example, o-rings, mechanical seals, lip seals, etc.

An electrical wire assembly 250, which may include for example one or more electrical wires and a sheath surrounding the one or more electrical wires, may extend between and be connected to the motor 230 and an external power source 260. Electrical wire assembly 250 may thus extend through the outer casing 232 of the motor 230 and the casing 212 of the conduit 210, so a wire seal 252 may be disposed between the outer casing 232 and the electrical wire assembly 250, and a wire seal 254 may be disposed between the casing 212 and the electrical wire assembly 250. Wire seal 252 may maintain the hermetic or other seal of the motor 230 in general. Wire seal 254 may prevent leakage of fluid from the conduit 210. Wire seals 252, 254 may be the same type of seals or different types of seals. Suitable types of wire seals 252, 254 include, for example, o-rings, potting, etc.

In exemplary embodiments, and due to the use of a motor 230 which is disposed within the inner passage 214, the outlet 218 of the conduit 210 may be generally coaxial with the inlet 216 along a longitudinal axis 280 of the conduit 210. Further, the inlet 216 and outlet 218 may each be generally perpendicular to the longitudinal axis 280. Notably, as discussed, the conduit 210, such as the casing 212 thereof, may be rigid or flexible. Further, the conduit 210 may extend in any suitable direction, which may be wholly or partially linear or curvilinear. The longitudinal axis 280 may extend along the length of the conduit 210 in the direction of the conduit 210 generally, such that portions of the longitudinal axis 280 may be linear and/or curvilinear in one or more directions, and the orientation of the inlet 216 and the outlet 218 may reflect such orientation of the longitudinal axis 280.

Pump assemblies 200 in accordance with the present disclosure provide a number of advantages due to the positioning of both the impeller 220 and the motor 230 within the inner passage 214 of the conduit 210. For example, such pump assemblies 200 require less power and generate fewer vibrations relative to many known appliance pumps. Further, such pump assemblies 200 take up less physical space and are less expensive relative to many known appliance pumps. Still further, the use of particular motor 230 embodiments such as low voltage DC motors makes the resulting pump assemblies safer relative to many known appliance pumps. Still further, the fluid flow direction 222 that is facilitated by such pump assemblies 200 may reduce fluid drag and provide improved efficiencies relative to many known appliance pumps.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A pump assembly for an appliance, the pump assembly comprising:

a conduit, the conduit comprising a casing extending between an inlet and an outlet and defining an inner passage, the inner passage providing fluid communication between the inlet and the outlet;

an impeller disposed within the inner passage; and a motor connected to the impeller and operable to rotate the impeller, the motor disposed within the inner passage, wherein fluid flowing within the inner passage is flowable around and past the motor.

2. The pump assembly of claim 1, wherein the motor comprises an outer casing and the outer casing is hermetically sealed.

3. The pump assembly of claim 1, further comprising a shaft and a shaft seal, the shaft connecting the impeller and the motor, the shaft seal disposed between the shaft and an outer casing of the motor.

4. The pump assembly of claim 2, further comprising an electrical wire assembly, a first wire seal and a second wire seal, the electrical wire assembly connected to the motor and extending through the outer casing of the motor and through the casing of the conduit, the first wire seal disposed between the electrical wire assembly and the casing of the conduit, the second wire seal disposed between the electrical wire assembly and the outer casing of the motor.

5. The pump assembly of claim 1, wherein the outlet is generally coaxial with the inlet along a longitudinal axis of the conduit.

6. The pump assembly of claim 1, wherein the conduit is a drain pipe.

7. An appliance, comprising:

a fluid source;

a pump assembly in fluid communication with the fluid source for flowing fluid from the fluid source, the pump assembly comprising:

a conduit, the conduit comprising a casing extending between an inlet and an outlet and defining an inner passage, the inner passage providing fluid communication between the inlet and the outlet;

an impeller disposed within the inner passage; and a motor connected to the impeller and operable to rotate the impeller, the motor disposed within the inner passage, wherein fluid flowing within the inner passage is flowable around and past the motor.

8. The appliance of claim 7, wherein the motor comprises an outer casing and the outer casing is hermetically sealed.

9. The appliance of claim 7, further comprising a shaft and a shaft seal, the shaft connecting the impeller and the motor, the shaft seal disposed between the shaft and an outer casing of the motor.

10. The appliance of claim 9, further comprising an electrical wire assembly, a first wire seal and a second wire seal, the electrical wire assembly connected to the motor and extending through the outer casing of the motor and through the casing of the conduit, the first wire seal disposed between the electrical wire assembly and the casing of the conduit, the second wire seal disposed between the electrical wire assembly and the outer casing of the motor.

11. The appliance of claim 7, wherein the outlet is generally coaxial with the inlet along a longitudinal axis of the conduit.

12. A dishwasher appliance, comprising:

a tub that defines a wash chamber for receipt of articles for washing;

a sump for collecting fluid from the wash chamber; and a pump assembly in fluid communication with the sump for flowing fluid from the sump, the pump assembly comprising:

a conduit, the conduit comprising a casing extending between an inlet and an outlet and defining an inner passage, the inner passage providing fluid communication between the inlet and the outlet;

an impeller disposed within the inner passage; and a motor connected to the impeller and operable to rotate the impeller, the motor disposed within the inner passage, wherein fluid flowing within the inner passage is flowable around and past the motor.

13. The dishwasher appliance of claim 12, wherein the motor is hermetically sealed.

14. The dishwasher appliance of claim 12, further comprising a shaft and a shaft seal, the shaft connecting the impeller and the motor, the shaft seal disposed between the shaft and an outer casing of the motor.

15. The dishwasher appliance of claim 12, further comprising an electrical wire assembly, a first wire seal and a second wire seal, the electrical wire assembly connected to the motor and extending through the outer casing of the motor and through the casing of the conduit, the first wire seal disposed between the electrical wire assembly and the casing of the conduit, the second wire seal disposed between the electrical wire assembly and the outer casing of the motor.

16. The dishwasher appliance of claim 12, wherein the outlet is generally coaxial with the inlet along a longitudinal axis of the conduit.

17. The dishwasher appliance of claim 12, wherein the conduit is a drain pipe.

* * * * *